United States Patent [19]

Hijazi

[11] Patent Number: 4,715,159

[45] Date of Patent: Dec. 29, 1987

[54] COLLAPSIBLE BUILDING CONSTRUCTION SYSTEM

[76] Inventor: Yousef Hijazi, P.O. Box 2, Makkah, Saudi Arabia

[21] Appl. No.: 916,380

[22] Filed: Oct. 7, 1986

[51] Int. Cl.[4] ..... E04H 12/18

[52] U.S. Cl. ..... 52/646; 52/79.5; 52/109; 52/64; 52/169.4; 52/741

[58] Field of Search ..... 52/79.5, 109, 646, 71, 52/64, 79.3, 169.4, 143, 79.9, 741; 182/131, 152, 157, 69

[56] References Cited

U.S. PATENT DOCUMENTS

| | | | |
|---|---|---|---|
| 1,886,962 | 11/1932 | La Roche | 52/79.9 X |
| 2,751,635 | 6/1956 | Donnahue | 52/79.9 X |
| 3,716,267 | 2/1973 | Lindsay | 52/143 X |
| 3,830,024 | 8/1974 | Warnke | 52/143 X |
| 3,849,952 | 11/1974 | Hanaoka | 52/79.5 |
| 3,971,185 | 7/1976 | Hendrich | 52/71 X |
| 4,583,331 | 4/1986 | Hunt et al. | 52/71 X |

FOREIGN PATENT DOCUMENTS

| | | | |
|---|---|---|---|
| L 11715 | 5/1956 | Fed. Rep. of Germany | 52/64 |
| 730408 | 8/1932 | France | 52/64 |

*Primary Examiner*—Carl D. Friedman

*Attorney, Agent, or Firm*—Alan B. Samlan

[57] ABSTRACT

A collapsible building construction system and method for erecting the same in which a plurality of horizontally disposed floor slabs are adapted to stack one on top of the other in a collapsed storage position. Pivotal columns connect the horizontally disposed floor slabs and provide for a scizzor-like movement between the floor slabs and the pivotal columns. The floor slabs assume a spaced parallel relationship with each other when opened. Room dividers are added to the structure after it is unfolded. Collapsible stairway structures provide access between floor. A series of collapsible building structures can be erected adjacent to each other to construct an entire facility. The collapsible building construction system is particularly well adapted for temporary building structures such as temporary living quarters, hospitals and classrooms. The construction system is adapted for erection on a mountainside, on a flat plane, or can be mounted on wheeled vehicles which can be transported to the construction site.

23 Claims, 15 Drawing Figures

COLLAPSIBLE BUILDING CONSTRUCTION SYSTEM

BACKGROUND OF THE INVENTION

The present invention relates to a collapsible building construction system and to a method for erecting such a system.

This invention is particularly adaptable for erecting temporary structures which can be used for living accommodations, hospital facilities, classrooms for schools, or other related applications requiring a temporary building structure.

There has existed a problem of supplying temporary housing for participants in large scale events which extend over several days, weeks, or months which can be quickly and easily erected or dismantled and yet is economical in its design and construction. Such temporary housing may be required for participants in religious or athletic events. One such example is the annual pilgrimage in Mecca, Saudia Arabia. During this one-month period a city is constructed, mainly out of tents, to house the over 2,000,000 pilgrims participating in this religious ritual. The problem is compounded by the fact that the landscape of the terrain where the temporary city is to be constructed is mountainous. Thus, it is advantageous if temporary housing can be built along the slopes of the mountains and on the flat terrain.

Another example where temporary living quarters may be required is in large athletic events such as in the Olympics or other such activities. Numerous athletes, families, and friends come together for a very short time. Nevertheless, the need for temporary housing, which may only be for a few days, is still required.

Another instance where temporary housing may be required is in the event of a natural disaster such as an earthquake or flood. In such a disaster, immediate housing is required for hundreds of families that have been left homeless. Also, emergency medical facilities normally must be erected in such a disaster area to care for the sick and injured. Thus, the need for a portable hospital facility which can be readily moved to the disaster area and quickly erected is readily apparent.

It has been discovered that through the use of multiple floor or terrace-style housing units, a high population density building can be most advantageously used. This is especially true where a higher density building is desired due to a limited space. Such construction in the past has considerably limited the privacy, living conveniences, and flexibility of design in such accommodation units.

SUMMARY OF THE INVENTION

The present invention provides a new collapsible building construction system which enables the user to quickly erect or disassemble high density living or office accommodations through the use of a preassembled collapsible building structure. The collapsible building structure can be utilized in numerous applications for temporary housing, offices, hospitals, classrooms, or other such structures. Furthermore, the collapsible structure can be adapted for use on a flat terrain, mounted onto a sloping terrain such as a mountain, or can be placed on wheeled vehicles for movement of a distant location wherein the vehicles can be stabilized and used as the base of the collapsible housing structure.

According to the broad aspect of the present invention, there is provided a multi-level building construction system constructed of main horizontal beams which support the horizontal floors and ceilings, and a series of pivotal columns connected to the horizontal beams in a scissor-like grid.

In one embodiment designed for providing collapsible housing structures to be built on a mountainside, the building structure is comprised of pre-fabricated aluminum units consisting of multiple collapsible floor slabs mounted to horizontal beams with the horizontal beams connected to each other by a scissor-like grid of vertical pivotal columns. When in the collapsed position, the aluminum floor slabs stack neatly above each other in a horizontal position. In the unfolded or erected position, the floor slabs are separated but each floor slab is connected to an adjacent foor slab by means of the vertical pivotal columns which maintain the horizontality of the floors while providing the structural strength to support the floors. The floors and ceilings are rigid. When the collapsible structure is unfolded, wall panels are hung to provide the individual housing units. The wall panels can be of canvas material. However, more rigid permanent type panels of fiberglass construction can be stored in the floors and ceilings and dropped into position when the housing structure is erected. This would provide greater protection from the elements and increased privacy.

When the system is designed for mounting against a mountainside, one end of the horizontal beam is anchored to the mountainside by means of concrete footings which can be placed along the side of the mountain. The rigid base or first floor is mounted to a concrete foundation sunk or poured into the ground. This provides a stable foundation from which the rest of the structure can be erected.

Applying the same concept, it is possible to combine a pair of units back-to-back which when unfolded are connected to and support each other. This approach allows collapsible structures to be built on a valley floor or similar horizontal terrain. The rigid base or first floor of each of the units is mounted to a concrete foundation or similar solidly imbedded structural support to provide a stable foundation. Braces are added as necessary to retain the structural rigidity of the units after they are unfolded. A collapsible staircase structure is provided adjacent to the housing structure to provide stairways allowing user movement between floors.

In another application, the collapsible housing structures can be mounted on trucks, trailers buses or similar wheeled vehicles. This would permit a collapsible housing structure to be easily and quickly moved to a location where it is needed. This would be particularly advantageous in the case of a natural disaster wherein temporary housing or hospital facilities are required. The basic collapsible housing structure would be driven to the location and the bus or truck would have stabilizing means to provide a rigid structural foundation. The collapsible system would then be unfolded and connected to provide the required facility.

OBJECTS AND ADVANTAGES

Accordingly, it is a primary object of this invention to provide a collapsible building construction system that is adapted for storage in a collapsed position and can be unfolded to provide an inhabitable building structure.

It is a further object to provide a collapsible building construction system that has horizontal floor slabs connected to each other by means of pivotal columns to provide for a scissor-like movement between the floor slabs and the pivotal columns to provide for the collapsibility of the structure.

Yet another object is to provide a collapsible building construction system that is adapted for erection on the side of a mountain or on a flat terrain.

Still another object is to provide a collapsible building construction system which is adaptable for mounting on vehicles such that it can be easily and quickly transported to the location where it is required.

Still another object is to provide a collapsible building construction system having rigid frame members which can quickly and easily be erected at the building site and having means for dividing the structure into separate rooms. Applicant's invention has the advantage of providing for canvas dividers or rigid panels which can be stored in the floors or ceilings which can be dropped into position after the frame is erected.

Yet another object is the object of providing a collapsible building construction system erected from modular sections which can be attached to other modular sections to increase the size of the overall building system. This provides the advantage of standardized modular components.

Other objects and advantages of the invention will become apparent upon reading the following detailed description and upon reference to the drawings.

DESCRIPTION OF THE PREFERRED EMBODIMENT

Figure 1:
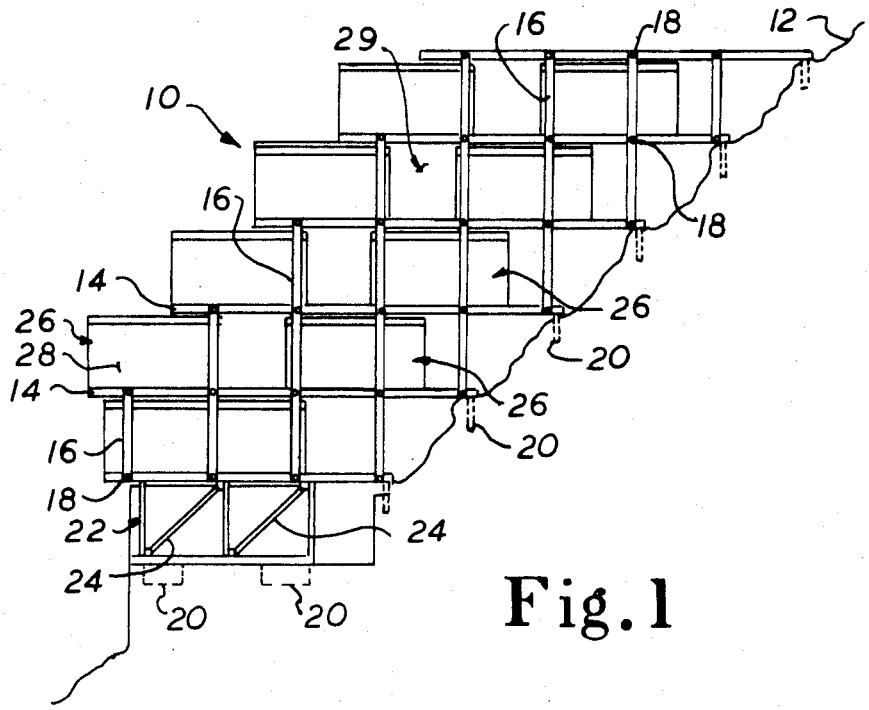
FIG. 1 is a side view of the collapsible building structure in the erected position wherein it is designed for construction on a mountainside at approximately a 45 degree angle.
Figure 11:
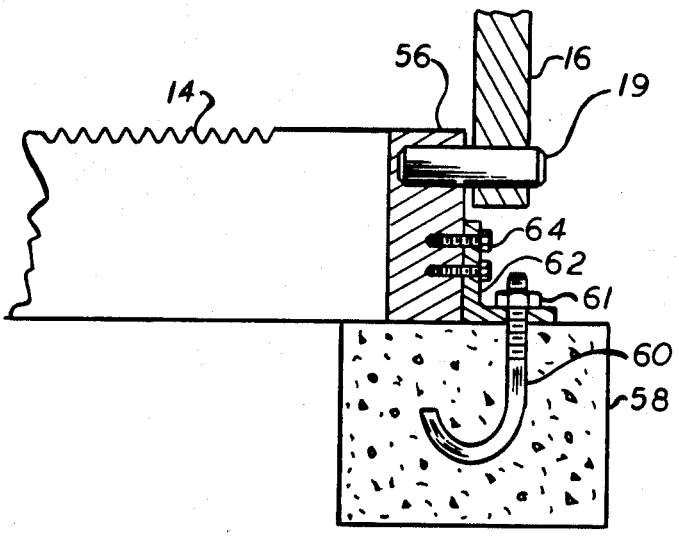
FIG. 11 is a cross-sectional view with portions removed illustrating one means of anchoring the building construction system into a concrete footing.

Turning to FIG. 1 there is illustrated a collapsible building construction system 10 adapted for mounting on a mountainside 12 at substantially a 45 degree angle with respect to the horizontal. The system 10 has a series of horizontal floor slabs 14 which serve a dual function of being a floor for one level and a ceiling for the level below. The floor slab 14 is framed by horizontal floor beams 15 for structural support and for ease in making the required pivot connections. A series of pivotal columns 16 are connected to the floor slabs 14 at pivot points 18 by means of pivot pins 19 (FIG. 11) which occur at each intersection of a pivotal column 16 and horizontal floor slab 14. The pivot points 18 and pivot pins 19 provide for a scissor-like movement between the floor slabs 14 and the pivotal columns 16 when the building construction system 10 is moved from its folded position to its erected position. The pivotal columns 16 also maintain the floor slabs 14 in a fixed parallel relationship with respect to each other when the system is in the erected position.

Figure 4:
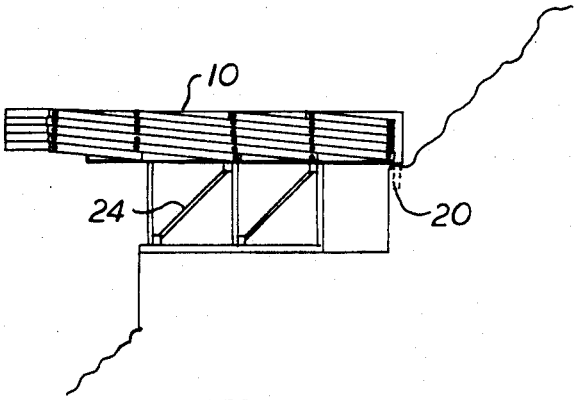
FIG. 4 is a side view of the building construction system of FIG. 1 in the collapsed position.

The building construction system 10 is affixed to the mountainside 12 at concrete footings 20 which are poured into place in the mountainside 12. A lower supporting structure 22 having braces 24 forms the base structure from which the rest of the building construction system is unfolded. This can best be seen in FIG. 4 wherein the system is collapsed with the exception of the base supporting structure 22 which maintains its configuration.

The height of the concrete footings 20 that support the base supporting structure 22 is set so that the base supporting structure is supported on the concrete footings 20 in a horizontal plane. The ends of the horizontal floor slabs 14 which contact the mountainside 12 are anchored into the concrete footings 20 by conventional means. One such method is to provide a receiving bracket (not illustrated) that is inbedded into the concrete footing 20. A complimentary bracket and pin extends from the floor beams 15 of the horizontal floor slab 14 and is received by the bracket imbedded into the concrete footing such that the horizontal floor slab is rigidly affixed to the mountainside 12. With each of the floor slabs 14 being affixed to a concrete footing 20, the unfolded building construction system 10 assumes the position shown in FIG. 1. It is rigidly and structurally sound, and as long as the concrete footings 20 are secure within the mountainside 12, the structure cannot be folded until the floor slabs are released from the footings 20.

Figure 2:
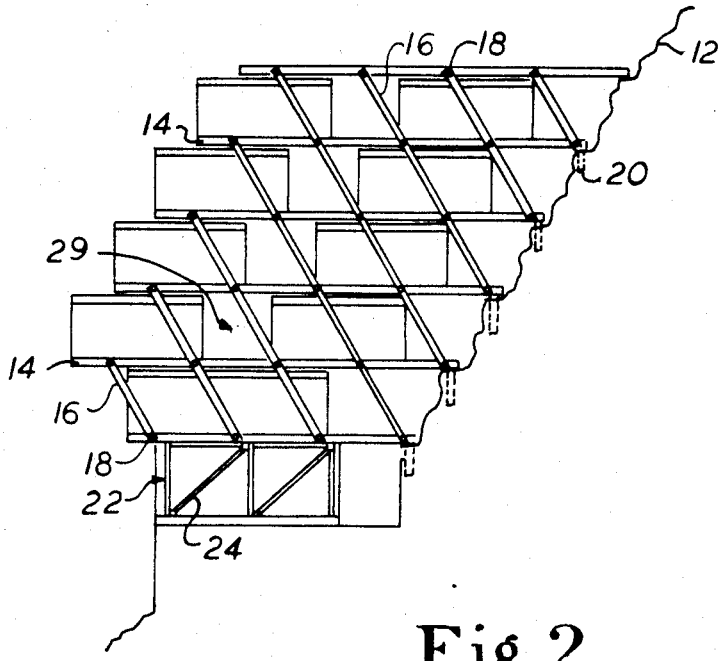
FIG. 2 is a side view of a collapsible building construction system similar to FIG. 1 except wherein the building system is adapted for construction along side a mountain at approximately 60 degrees with respect to the horizontal.

If the mountainside is at a steeper angle, such as approximately 60 degrees as illustrated in FIG. 2, the building construction system 10 will still be usable. The horizontal floor slabs 14 are once again anchored into the concrete footings 20 by conventional means. However, as can be seen in FIG. 2, the pivotal columns 16 do not assume a vertical position. Rather, they will assume a position at an angle other than 90 degrees with respect to the horizontal depending upon the angle of the mountainside 12. As long as the ends of the floor slabs 14 are rigidly affixed to the concrete footings 20, the structure will be secure and safe. The height of the individual floors will be lessened somewhat as compared to the structure shown in FIG. 1 due to the fact that the pivotal columns 16 are not permitted to assume their full vertical upright position. As long as the pivotal columns 16 are permitted to be raised to a height that separates the floor slabs a sufficient distance for the use intended, the collapsible building construction system 10 is usable.

Once the building construction system is erected, individual living or accommodation quarters can easily be added. In one instance hooks are provided at various positions along the horizontal floor slabs. Canvas material having rings therein are hung from the hooks to provide privacy between adjacent accommodations. The canvas material can be supplied with window flaps, screens, or other such amenities as are provided for in tents. This type of structure can be very quickly and inexpensively constructed with the individual accommodation units being very quickly constructed.

If additional privacy or protection from the elements is required, rigid fiberglass panels can be used as room dividers. These panels can be stored in the floor slabs 14 and can be fastened at their tops by pivot connections to allow the panels to be dropped down into position after the construction system 10 is fully erected. The floor slabs 14 can be easily adapted to receive the panels in a stored position so that it will not interfere with the system when it is folded or collapsed. The individual accommodation units are illustrated in FIG. 1 as reference numeral 26 having walls 28. Hallways 29 are provided between the accommodation units 26.

Figure 3:
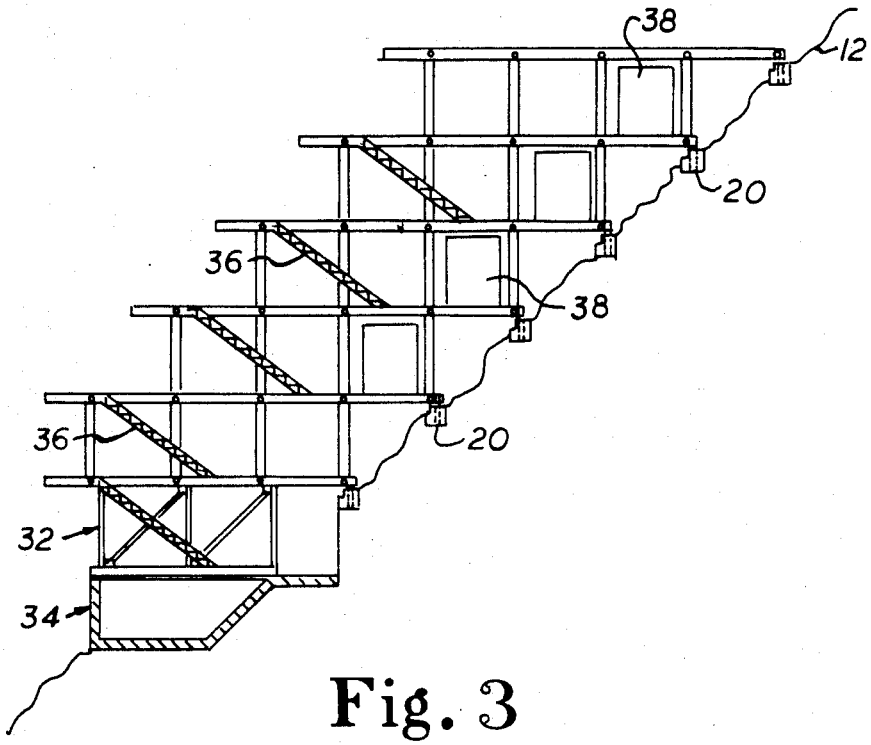
FIG. 3 is a side view partially in cross-section of a stairway structure used to provide access to the various floors of the collapsible building construction system.

Stairways must be provided in order to provide access between floors. A stairway unit 30 is illustrated in FIG. 3. The base structure 32 is similar to the base structure 22 which supports the collapsible building construction system 10. The base supporting structure 32 as illustrated is mounted on a concrete platform 34 instead of using the concrete footings 20. This is an alternate configuration to the base structure 22. The horizontal floor slabs 14 are still mounted in concrete footings 20 imbedded in the mountainside 12. A series of stairways 36 connect each floor to an adjacent floor. In order to make maximum use of the space within the structure, the stairways have been found to be an appropriate place to locate toilet and washing facilities. Privacy can be achieved by hanging canvas walls or using fiberglass panels to construct private rooms as previously described. Passageways 38 can also be provided for in the stairway unit 30 to provide for additional entrances and exits and other access means between adjacent building construction systems. In this manner a complete and extensive temporary accommodation structure can be completed. In order to achieve the greatest density of living accommodations per square foot, one stairway unit 30 would be used for each two or more accommodation structures.

Figure 5:
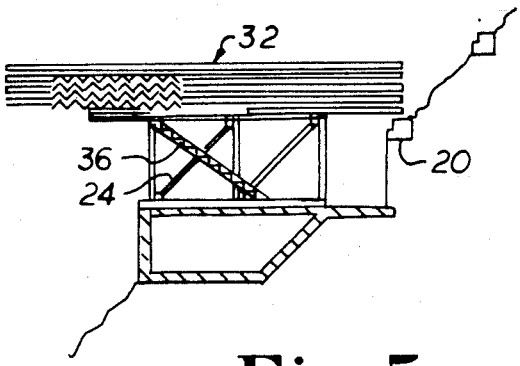
FIG. 5 is a side view of the stairway system as illustrated in FIG. 3 in the collapsed position.

Turning to FIG. 5, the stairway unit 30 is illustrated in the collapsed position. One can see that it closely resembles the collapsed construction system illustrated in FIG. 4. This provides for ease in construction in that the units are unfolded and fastened to the mountainside in the same manner. Also, as the basic construction is the same, many parts can be standardized throughout the structures.

Figure 6:
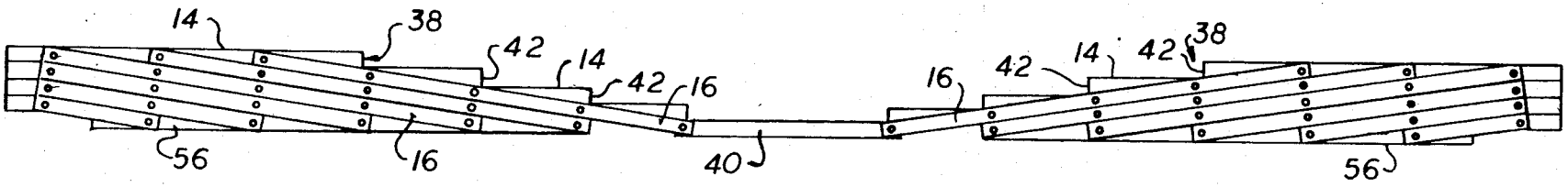
FIG. 6 is a front view of two collapsible modular structures to be erected adjacent to each other on flat terrain with both structures being in the collapsed position.

Applying the same foldable concept to accommodation units on a flat terrain, it is possible to combine a pair of units which when unfolded have their ends attached to each other and thereby support each other. This concept is clearly illustrated in FIGS. 6–10. In FIG. 6 the two units are illustrated in their collapsed positions.

Figure 12:
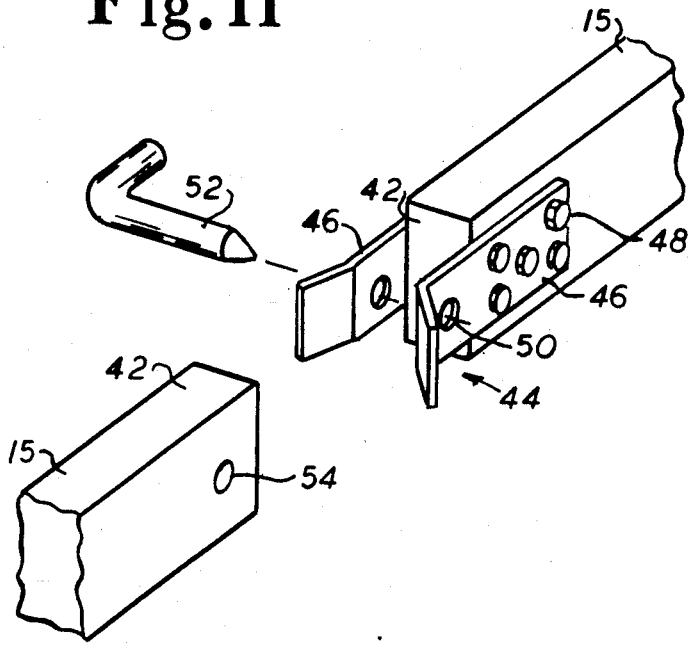
FIG. 12 is a perspective view with portions removed illustrating one method of fastening the floor beams of one modular structure to an adjacent modular structure.

As seen in FIG. 6, there is a pair of accommodation structures 38 connected by a connecting bottom beam 40. When the accommodation structures 38 are unfolded and erected, ends 42 of the floor base 15 which face each other will eventually butt up against each other. Connectors 44 such as illustrated in FIG. 12 are used to join the ends 42 to each other. The connectors 44 comprise a pair of opening flanges 46 which are fastened by means of bolts or rivets 48 to the end 42. Each of the opening flanges 46 has a hole 50. There is a complimentary hole 54 in the end 42 that is to be connected. The holes 50 and 54 are in alignment with each other so that a pin 52 can be placed through both holes. Thus the pin 52 will securely fasten the ends 42 to each other.

Figure 7:
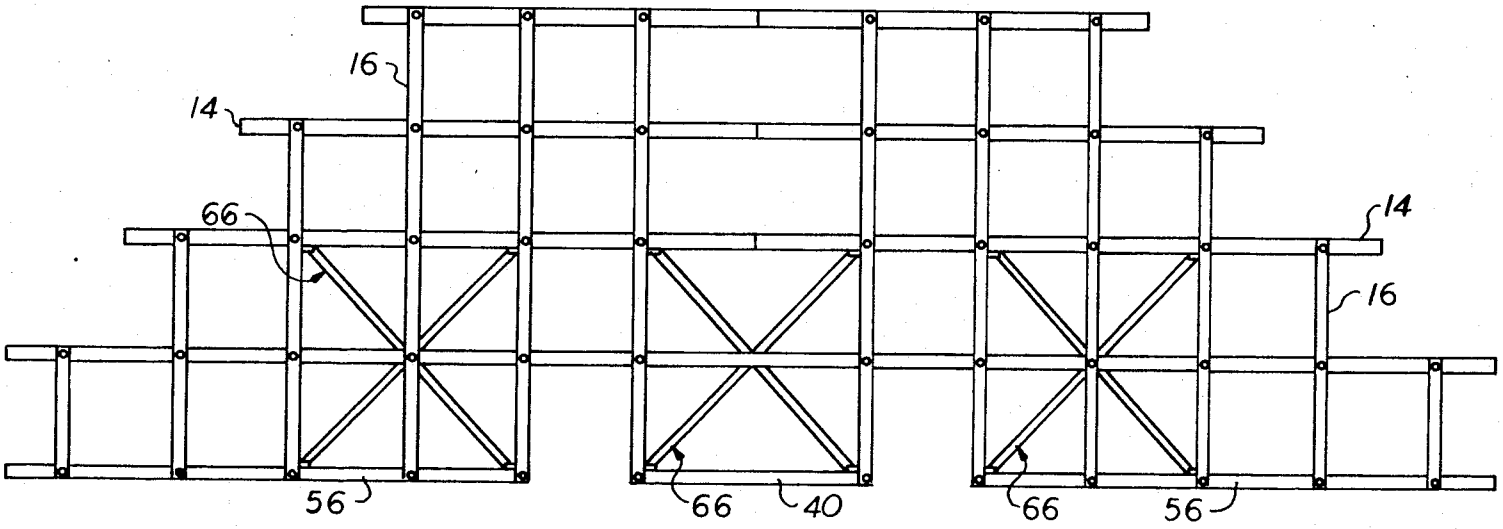
FIG. 7 is a front elevation view of the modular collapsible building construction system shown in FIG. 6 in the erected position.

As can be seen in FIG. 7, the bottom of each of the accommodation structures 38 has a bottom beam 56. The bottom beam 56 is secured to the ground in the manner illustrated in FIG. 11. A concrete footing 58 is poured into the ground with J bolts 60 imbedded into the concrete footing 58. A bracket 62 has one of its legs secured to the J bolt 60 with bolts 61 and the other leg fastened to the bottom beam 56 by means of bolts 64. The connecting bottom beam 40 is preferably also securely fastened to a concrete footing 58 in a manner similar to that previously described for the bottom beam 56.

With the accommodation structures 38 fully erected, X braces 66 are added to provide additional structural support. These X braces are placed at appropriate points between floor slabs, as illustrated in FIG. 7, to add structural stability and are removed when the structure is to be collapsed.

Figure 13:
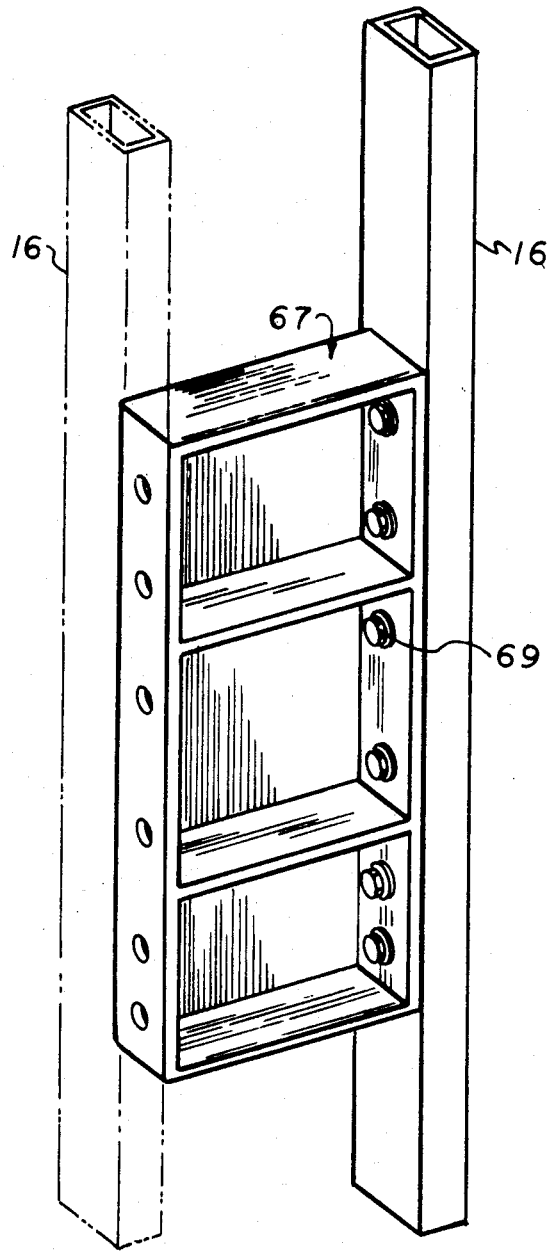
FIG. 13 is a perspective view of a bracket box used to fasten adjacent structures to each other.

FIG. 13 illustrates a bracket box 67 used to fasten the columns 16 of one structure to an adjacent structure. The bracket box is fastened to the columns 16 by bolts 69. A sufficient number of bracket boxes 67 must be used to securely fasten the structures side by side as they are erected.

Figure 10:
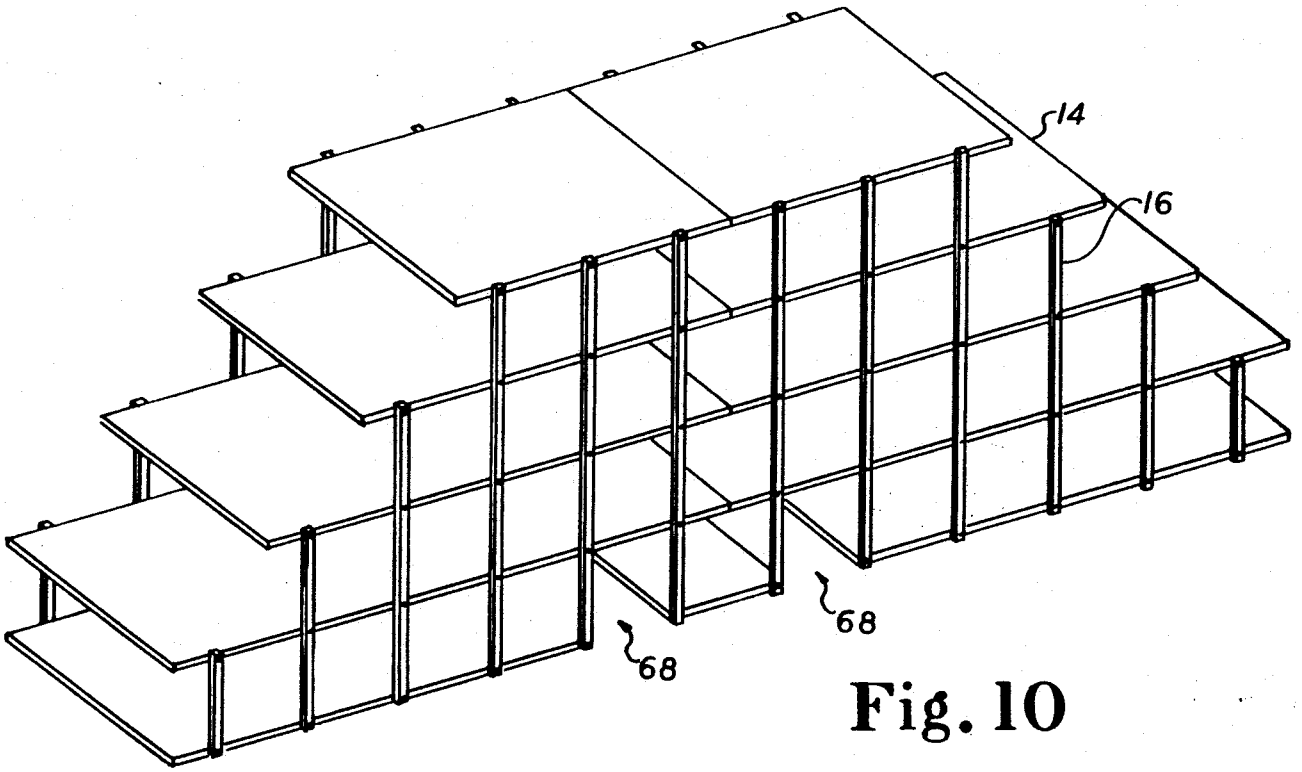
FIG. 10 is a perspective view of the collapsible building construction system of FIG. 6 in the fully erected position but with the supporting braces removed.

Through the use of stairway units such as previously described, a complete multi-level community can be quickly erected. Passageways for pedestrian or vehicular traffic can be provided such as illustrated in FIG. 10 as passageways 68. These passageways 68 can be designed to pass throughout the entire series of accommodation structures 38.

Figure 8:
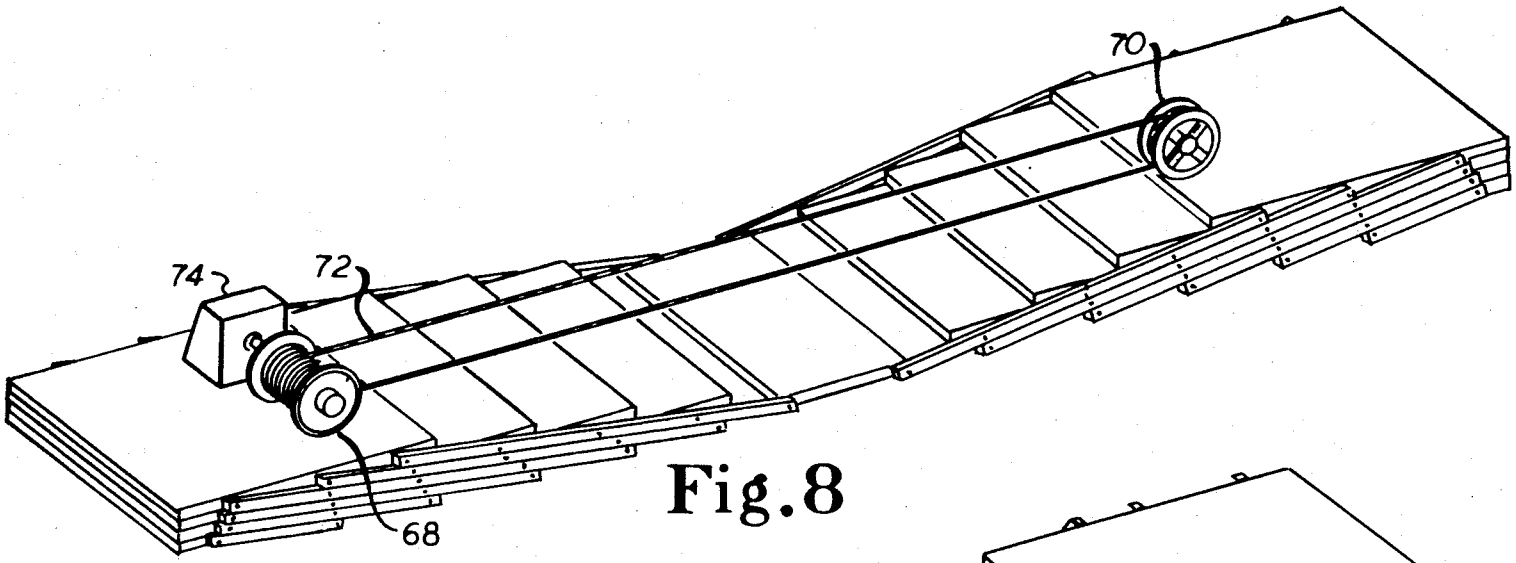
FIG. 8 is a perspective view of a winching device which can be used to raise the two modular structures into the fully erected position.
Figure 9:
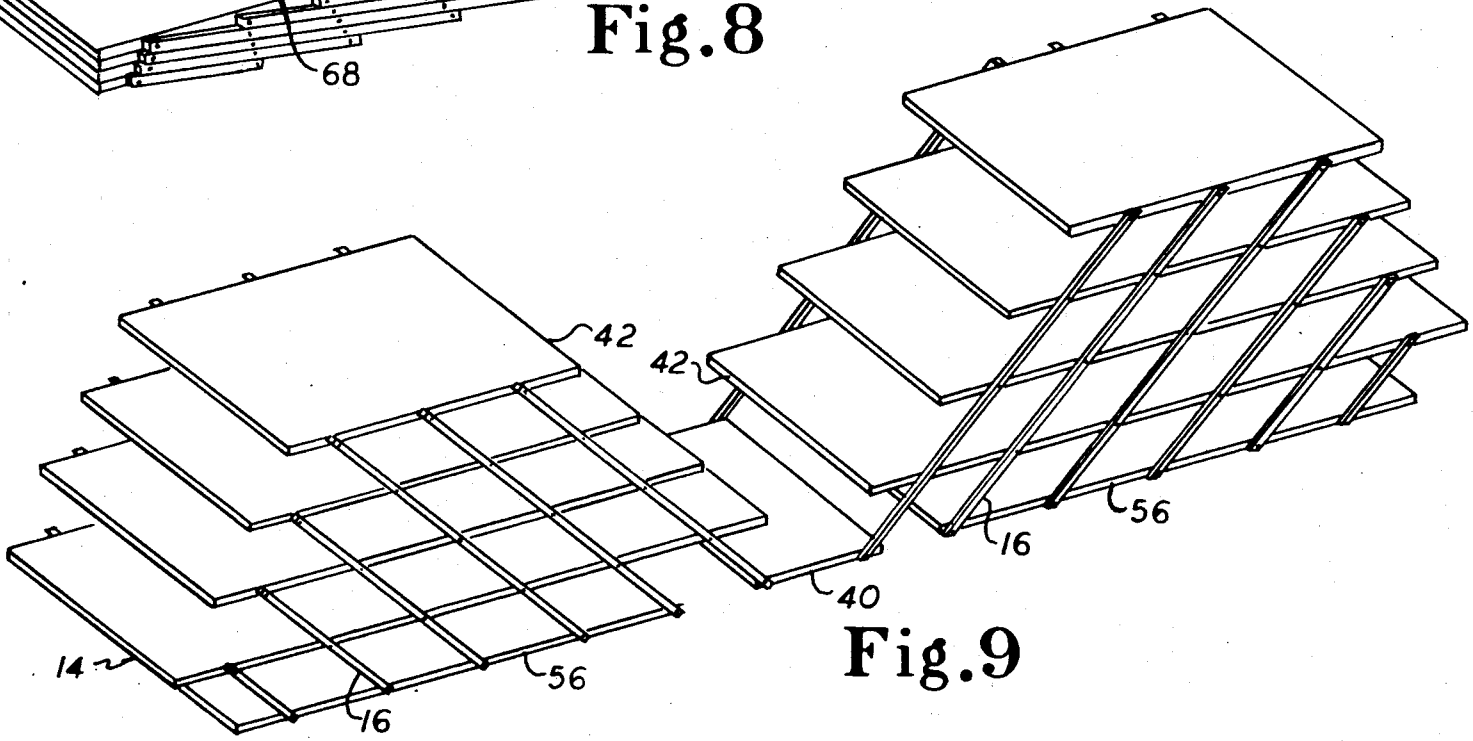
FIG. 9 is a perspective view of the device shown in FIG. 6 as it is approximately one-half raised from its collapsed to its fully constructed position.

The accommodation structures 38 can be erected by conventional means such as using a crane to lift up the folded accommodation structures 38. The crane will hold them in place while the connectors 44 are fastened and until the X braces 66 are securely in place. However, cranes may not always be easily available, and they must be transported to the construction site. Applicant has devised a new and unique method of erecting the accommodation structures 38 without the need of a crane. This is best illustrated in FIG. 8. A winch 68 is fastened on top of one of the accommodation structures 38. A pulley 70 is mounted on top of the other structure. A steel cable 72 has one end connected to the top of the same accommodation structure 38 on which the winch is mounted. The other end of the cable is connected and wound around the winch 68. The winch is slowly turned by means of a motor and gear box 74. As the winch 68 turns, the cable 72 is wrapped around the winch 68 and pulls the top floors 14 towards each other. The only direction that the two structures can move is to have the pivotal columns 16 pivot in the upward direction raising the floor slabs 14. Thus, the two accommodation structures 38 will raise themselves, slowly assume the position shown in FIG. 9, and finally be fully erected as illustrated in FIG. 10.

Other means of erecting the structures can be utilized, such as applying a horzontal force to the bottom of the pivotal columns 16 causing the pivotal columns to move into an upright position. Another method is to use hydraulic jacks or inflatable air bags positioned between floor slabs. As the jacks or air bags are expanded, they will raise the floors. Those skilled in the art will be able to devise other erecting procedures wherein the horizontal floor slabs are pulled upright and the pivotal columns will be pivoted from a substantially horizontal to a vertical orientation.

Figure 14:
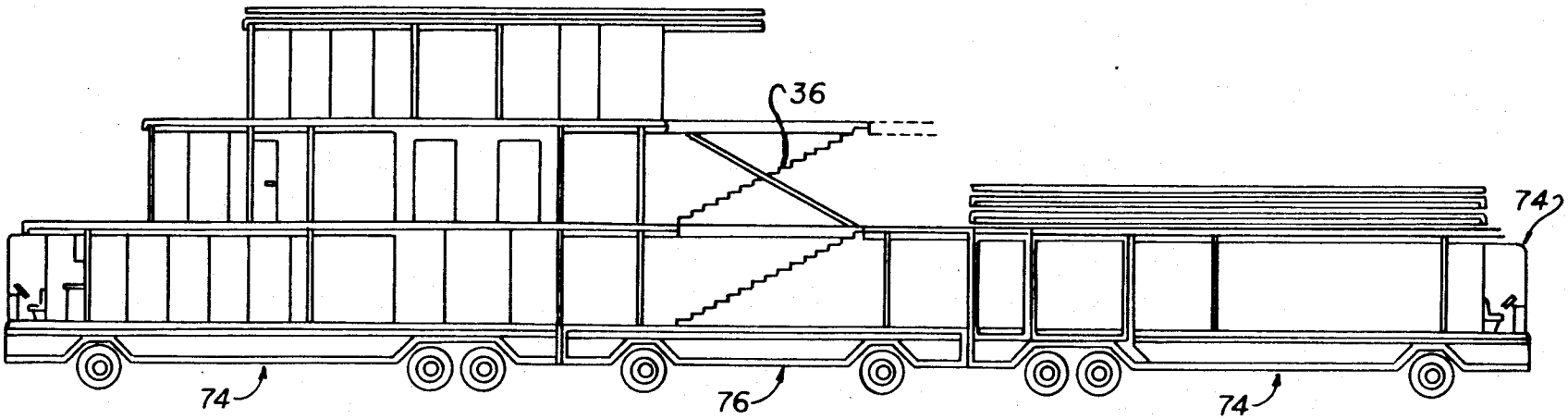
FIG. 14 is a side view of a collapsible building construction system adapted for mounting on buses and trailers with one of the structures erected.
Figure 15:
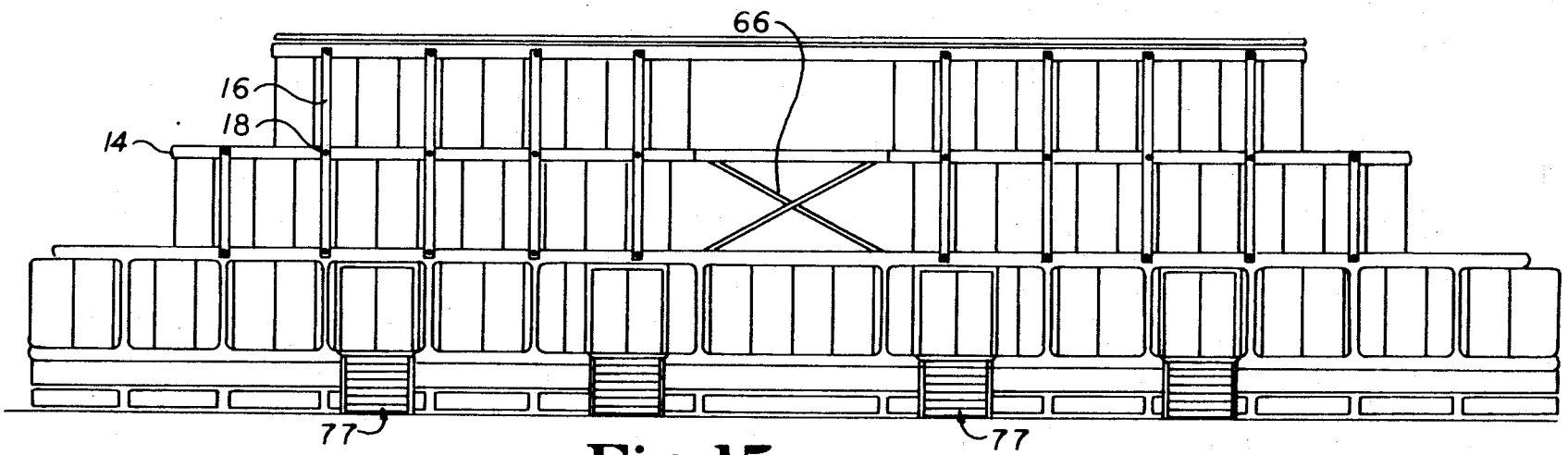
FIG. 15 is a side view of the collapsible building construction system of FIG. 14 in its completely erected position.

There are times when emergency hospitals must be set up at areas of natural disasters. Similarly, housing accommodations or schools may have to be quickly set up for only a relatively short time period. In such instances it is desirable if the collapsible building construction system can be mounted on wheeled vehicles. Such an application is illustrated in FIGS. 14 and 15. Two buses 74 have the basic building construction system 10 folded and mounted onto the top of the bus 74. A trailer 76 has the stairway unit collapsed and stored thereon. The buses 74 are capable of being driven to the site where the temporary housing structures are required. When the wheeled vehicles reach the site, they are stabilized by conventional means so that they can form a stable base from which the building construction system can be formed. Hydraulic jacks or hydraulic stabilizing braces such as typically found on construction equipment can be utilized. The collapsible building construction system 10 is unfolded by means of cranes or the winch system as previously described. Braces are added as required in order to stabilize the structure. The tires can be concealed using panels. Stairs 77 are folded out from storage compartments. The buses 74 are designed to become part of the building system and may house classroom facilities, hospital facilities, living quarters, or whatever type of facility is required at the building site. The individual accommodations are created by fiberglass panels being pivoted from the floor slabs such as previously described.

By positioning additional buses 74 adjacent to each other, the overall building construction system can be built to the required size. Passageways are designed to allow occupants to pass through each of the adjacent buses without going outside of the structure. Stairway structures provide access between levels. When the need for the temporary accommodation structure has passed, the units are collapsed and driven or trailered to the next required site.

It has been determined that the best choice of building material for the entire structure of the collapsible building construction system is aluminum. The aluminum horizontal floor slabs can be covered with a synthetic material such as polyurethane for waterproofing, fire resistance, and high sound absorbancy. An aluminum design is lightweight, strong, and resists deterioration from the elements.

Thus it is apparent that there has been provided, in accordance with the invention, a collapsible building construction system and method for erecting the same that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A collapsible building construction system comprising:

a plurality of horizontally disposed floor slabs which are adapted for stacking one on top of the other in a collapsed storage position and which are adapted to assume a spaced parallel relationship with each other when placed in an opened position, pivotal columns for connecting the horizontally disposed floor slabs to the adjacent floor slabs, the pivotal columns connected to the floor slabs at pivot points to provide for a scissor-like movement between the floor slabs and the pivotal columns, removable partitions that divide the space between floor slabs into rooms comprising foldable panels stored in compartments in the floor slabs which are removed from the compartments and locked in place, and means for bracing the floor slabs and the pivotal columns in the opened position.

2. The system of claim 1 wherein the means for bracing the floor slabs and the pivotal columns comprises brackets with one leg of the bracket attached to the floor slab and the other leg of the bracket attached to the pivotal column.

3. The system of claim 1 wherein the means for bracing the floor slabs and the pivotal columns comprises bracing rods attached between adjacent floor slabs.

4. The system of claim 1 and further comprising anchoring means on the floor slabs for attaching the floor slabs to permanent supports in a mountain slope.

5. The system of claim 1 and further comprising means on the bottom floor slab for attaching it to a permanent footing in the ground.

6. The system of claim 1 and further comprising stair structures that provide a means of access to each floor slab when in the opened position.

7. The system of claim 1 wherein the horizontally disposed floor slabs and pivotal columns are mounted on wheeled vehicles, the wheeled vehicles providing a base foundation for the building construction system.

8. The system of claim 7 wherein the wheeled vehicles are provided with stabilizing means for maintaining the building construction system in a stable upright position when the floor slabs are placed in an opened position.

9. A collapsible building structure for erection on a flat ground surface comprising:

at least two collapsible modular structures to be erected adjacent each other, each modular structure comprising:

a plurality of horizontally disposed floor slabs which are adapted for stacking one on top of the other in a collapsed storage position and which are adapted to assume a spaced parallel relationship with each other when placed in an opened position, each floor slab having sides and ends, pivotal columns for connecting the horizontally disposed floor slabs to the adjacent floor slabs, the pivotal columns connected to the sides of the floor slabs at pivot points to provide for a scissor-like movement between the floor slabs and the pivotal columns.

means for bracing the floor slabs and the pivotal columns in the opened position, means for attaching the ends of the floor slabs of one of the modular structures to complimentary ends of the floor slabs of the adjacent modular structure when both modular structures are in the opened position and removable partitions that divide the space between floor slabs into rooms comprising foldable panels stored in compartments in the floor slabs which are removed from the compartments and locked in place.

10. The structure of claim 9 wherein the means for bracing the floor slabs and the pivotal columns comprises brackets with one leg of the bracket attached to the floor slab and the other leg of the bracket attached to the pivotal column.

11. The structure of claim 9 wherein the means for bracing the floor slabs and the pviotal columns comprises bracing rods attached between adjacent floor slabs.

12. The structure of claim 9 wherein the horizontally disposed floor slabs of one modular structure is in horizontal alignment with a corresponding floor slab of the second modular structure when the structures are in their opened positions.

13. The structure of claim 9 wherein the means for attaching one modular structure to the adjacent modular structure comprises a flange fastened to one structure, the flange having an opening to receive a complimentary locking member on the adjacent modular structure, and locking means to lock the flange to the complimentary member.

14. The structure of claim 9 and further comprising stair structures that provide a means of access to each floor slab when in the opened position.

15. The structure of claim 14 wherein the stair structures are individual collapsible stair structures that are attached to the collapsible modular structures when all of the structures are in their opened positions.

16. The structure of claim 9 wherein the collapsible modular structures are mounted on wheeled vehicles, the wheeled vehicles providing a base foundation for the building structure.

17. The structure of claim 16 wherein the wheeled vehicles are provided with stabilizing means for maintaining the building construction system in a stable upright position when the floor slabs are placed in an opened position.

18. A collapsible building construction system comprising:

at least two collapsible modular structures to be erected adjacent each other, each modular structure comprising:

a plurality of horizontally disposed floor slabs which are adapted for stacking one on top of the other in a collapsed storage position and which are adapted to assume a spaced parallel relationship with each other when placed in an opened position, each floor slab having sides and ends, removable partitions that divide the space between floor slabs into rooms comprising foldable panels stored in compartments in the floor slabs which are removed from the compartments and locked in place, pivotal columns along the sides of the rectangular floor slabs for connecting the horizontally disposed floor slabs to the adjacent floor slabs, the pivotal columns connected to the sides of the floor slabs at pivot points to provide for a scissor-like movement between the floor slabs and the pivotal columns, means for fastening one collapsible modular structure to the adjacent structure when the two structures are placed with the sides of the floor slabs adjacent each other, and means for bracing the floor slabs and the pivotal columns in the opened positions.

19. The system of claim 18 wherein the means for fastening one collapsible modular structure to the adjacent structure comprises a brace-type member that is attached to the pivotal column on one collapsible structure and to a corresponding pivotal column on the adjacent structure.

20. The system of claim 18 and further comprising more than two collapsible modular structures erected adjacent each other wherein one of the modular structures is a stair structure that provides a means of access to each floor slab when in the opened position.

21. The system of claim 18 wherein the collapsible modular structures are mounted on wheeled vehicles, the wheeled vehicles providing a base foundation for the building structure.

22. The system of claim 21 wherein the wheeled vehicles are provided with stabilizing means for maintaining the building construction system in a stable upright position when the floor slabs are placed in an opened position.

23. A method of erecting a collapsible building construction system wherein two collapsible modular structures are to be erected end to end adjacent each other and wherein the modular structures have a plurality of floor slabs which are connected by pivotal columns, the method comprising:

attaching cable means from a top surface of one of the structures to a top surface of the second structure, applying a force to the cable means to pull the top surfaces towards each other, and pivoting the columns to an upright position thereby opening the collapsible system.

* * * * *